US011046068B2

(12) United States Patent
Richards et al.

(10) Patent No.: US 11,046,068 B2
(45) Date of Patent: Jun. 29, 2021

(54) DIRECT-TO-TRANSFER PRINTING SYSTEM AND PROCESS, AND COMPONENTS AND ASR SYSTEM THEREFOR

(71) Applicant: Fanatics, Inc., Jacksonville, FL (US)

(72) Inventors: Daryl Richards, Jacksonville, FL (US); Timothy Brule, Tampa, FL (US)

(73) Assignee: FANATICS, INC., Jacksonville, FL (US)

( * ) Notice: Subject to any disclaimer, the term of this patent is extended or adjusted under 35 U.S.C. 154(b) by 268 days.

(21) Appl. No.: 16/283,414

(22) Filed: Feb. 22, 2019

(65) Prior Publication Data

US 2019/0263109 A1 Aug. 29, 2019

Related U.S. Application Data

(60) Provisional application No. 62/635,129, filed on Feb. 26, 2018.

(51) Int. Cl.
*B41F 16/02* (2006.01)

(52) U.S. Cl.
CPC ..... *B41F 16/02* (2013.01)

(58) Field of Classification Search
CPC ..... B41F 16/00–02
See application file for complete search history.

(56) References Cited

U.S. PATENT DOCUMENTS 3,620,881 A * 11/1971 Herbert Kannegiesser ..... B41F 16/02 156/388
4,750,419 A * 6/1988 Meredith ..... B41F 15/0872 101/40
5,020,430 A * 6/1991 Harpold ..... B41F 15/0863 101/115
5,226,362 A * 7/1993 Iaccino ..... B41F 15/0863 101/126
5,335,594 A * 8/1994 Karlyn ..... B41F 15/0863 101/115
5,526,742 A * 6/1996 Petersen ..... B41F 15/0863 101/129
5,658,647 A 8/1997 Magill et al.
5,939,207 A 8/1999 Fensore et al.
(Continued)

OTHER PUBLICATIONS

Cahill, V., "An Introduction to Digital Printing Technology", SIGO, Jul. 2011.
HP Indigo Digital Offset Printer, May 2016.

*Primary Examiner* — Nguyen Q. Ha
(74) *Attorney, Agent, or Firm* — Venable LLP

(57) ABSTRACT

The present invention provides a system and process for direct-to-transfer printing, including heat presses and corresponding heat press stations through which the heat presses are indexed, and at which garments are (1) dressed upon the heat presses; (2) the garments are pre-pressed; (3) thereafter components are sequentially placed on top of and fused with their corresponding garments by applying heat and pressure; and (4) the finished garments are unloaded from the heat presses. The present invention also provides a component on a carrier sheet for use in such a direct-to-transfer printing system and process, which includes identification and registration symbols (such as barcodes, QR codes or other suitable markings) in addition to a design or embellishment. The present invention further provides an ASR system for use with a direct-to-transfer printing system.

15 Claims, 9 Drawing Sheets

(56) References Cited

U.S. PATENT DOCUMENTS 5,970,874 A * 10/1999 Bill ..... B41F 16/02 101/115
6,053,101 A * 4/2000 Hix ..... B41F 15/0863 101/115
6,192,794 B1 * 2/2001 DeCruz ..... B41F 15/0813 101/126
6,540,345 B1 4/2003 Wagner et al.
6,631,495 B2 10/2003 Kato et al.
6,824,868 B2 11/2004 Bell et al.
6,984,281 B2 1/2006 Oshima et al.
7,081,324 B1 7/2006 Hare et al.
7,502,133 B2 3/2009 Fukunaga et al.
8,477,163 B2 7/2013 Hirst
8,848,010 B2 9/2014 Keeton et al.
8,893,418 B1 11/2014 Yochum
9,056,488 B2 6/2015 Rawlings et al.
9,193,204 B2 11/2015 Dinescu et al.
9,296,243 B2 3/2016 Stevenson et al.
9,302,468 B1 4/2016 Xu
9,460,642 B2 10/2016 Tanrikulu et al.
9,623,578 B1 4/2017 Aminpour et al.
9,695,548 B2 7/2017 Caldwell
9,701,153 B2 7/2017 Chiao et al.
9,782,906 B1 10/2017 Aminpour et al.
9,868,302 B1 1/2018 Aminpour
9,895,819 B1 2/2018 Aminpour
10,189,278 B1 * 1/2019 Friedrich ..... B41J 13/0009
2005/0015311 A1 1/2005 Frantz et al.
2006/0207448 A1 * 9/2006 Fresener ..... B41J 3/4078 101/115
2015/0032887 A1 1/2015 Pesek et al.
2016/0024174 A1 1/2016 Odunsi et al.
2016/0200118 A1 7/2016 Xu
2017/0036472 A1 2/2017 Will et al.
2019/0106838 A1 * 4/2019 Hoffman, Jr. ..... B41F 16/02
2020/0230946 A1 * 7/2020 Li ..... B41F 16/0046

* cited by examiner

DIRECT-TO-TRANSFER PRINTING SYSTEM AND PROCESS, AND COMPONENTS AND ASR SYSTEM THEREFOR

CROSS REFERENCE TO RELATED APPLICATION FOR WHICH A PRIORITY BENEFIT IS CLAIMED UNDER 35 U.S.C. § 119

The present patent application claims priority under 35 U.S.C. § 119(e) to U.S. Provisional Application No. 62/635,129, filed Feb. 26, 2018, the entire disclosure of which is incorporated by reference herein.

FIELD OF THE INVENTION

The present invention relates to the field of direct-to-transfer printing.

BACKGROUND OF THE INVENTION

A component 100 comprising a design or embellishment 102 is typically made or an adhesive-backed fabric, vinyl or various kinds of ink placed a carrier sheet 101. An example of a component 100 is shown in FIG. 1. The carrier sheet 101 is typically in the shape of a rectangle and is slightly larger than the component 100. Generally, the carrier sheet 101 can be any size and shape, and often has nothing but the component 100 on it. Typically the carrier sheet is made from PET (polyethylene terephthalate), resulting in a clear plastic sheet similar to transparency film.

Typically a heat press is used to apply heat and pressure to fuse the component and its design or embellishment to a garment. An example of a heat press 104 is shown in FIG. 2. The heat press 104 typically has a bottom platen 105 on which the garment can be dressed. A heated top platen 106 (usually of similar size to the bottom platen) can then be moved into placed and engaged with the bottom platen, thereby applying heat and pressure to the component. There are many different types and styles of heat presses, but they typically all have heated plates that can apply heat and pressure for segments of time.

As shown in FIG. 1, in a conventional transfer process, a garment 103 is dressed on the bottom platen of the heat press 104. Carrier sheet 101 is placed on top of the garment 103 with the component 100 and its design or embellishment 102 placed image side down, so it is adjacent to the garment 103. Heat and pressure are applied by the heat press 104 to the component 100 through the carrier sheet 101. The component 100, and thus the design or embellishment 102, is fused to the garment 103 by the application of heat and pressure for a period of a time. The spent carrier sheet 101 is then removed and discarded.

MTO stands for "made-to-order" and refers to garments that are decorated with the design or embellishment after a customer places an order for them. MTO requires a production process that is set up to produce individual garments of a wide variety of designs and embellishments, as opposed to many copies of a garment each having the same design or embellishment thereon.

Currently in the market there are digital printing processes in which the designs or embellishments on garments are printed or embroidered directly thereon without the use of components. Typical MTO embellishment processes are direct-to-garment printers and single-head embroidery machines. Direct-to-garment printers (for example, the ones sold under the Kornit Atlas brand) are inkjet printers generally designed for cotton T-shirts and fleece garments. They are slower than bulk manufacturing processes and expensive (for example, a machine that delivers only around 100 embellishments per hour can cost over $500,000), and there are limitations on what type of garments can be printed upon. Usually any fabric other than cotton is difficult to print on, and every fabric must first be checked for compatibility with the printer. Even then, small garment manufacturing changes can lead to inconsistent prints. Embroidery machines are even slower. The simplest designs typically take a two minutes to complete, yielding at best 30 embellishments per hour. Many designs, however, take much longer to complete, with some over an hour.

The current digital printing processes are either too slow for printing differing designs on garments (especially MTO garments), or if faster, they do not permit the printing of differing designs. Rather, faster processes typically comprise a production run of printing a multitude of copies—that is, tens or hundreds of garments each having the same design printed thereon. In addition, when traditionally creating a component, a screen or die must be made for each color and design. The creation of the screen or die is a time consuming and expensive process and is not feasible for the creation of a single component with a unique design.

Accordingly, there is a need for a direct digital printing process that is faster and permits unique and differing designs or embellishments to be printed on garments, especially MTO garments. Moreover, this process ought not to be limited by the need to create a screen or die for each unique design.

SUMMARY OF THE INVENTION

One object of the present invention is to provide a system and process for direct-to-transfer printing, including heat presses and corresponding application (heat press) stations through which the heat presses are indexed, and at which garments are (1) dressed upon the heat presses; (2) the garments are pre-pressed; (3) thereafter components are sequentially placed on top of and fused with their corresponding garments by applying heat and pressure; and (4) the finished garments are unloaded from the heat presses.

Another object of the present invention is to provide a component on a carrier sheet for use in such a direct-to-transfer printing system and process, which includes identification and registration symbols (such as barcodes, QR codes or other suitable markings) in addition to a design or embellishment.

Yet another object of the present invention is to provide an ASR system for use with a direct-to-transfer printing system, which includes one or more vertical storage modules, wherein each vertical storage module has multiple storage locations for storing components, and a control system for storing the storage and retrieval of the components to and from their respective storage locations.

According to one aspect of the invention, components are delivered manually to the application stations.

According to another aspect of the invention, components are delivered automatically to the application stations. Preferably, the components are automatically stored and retrieved prior to delivery.

According to yet another aspect of the invention, garments have stickers placed thereon containing identification symbols (such as barcodes, QR codes or other suitable markings), to permit matching them up with corresponding components.

Further characteristics and advantages of the present invention will become apparent from the following detailed description of preferred but not exclusive embodiments of the novel direct-to-transfer printing system and process, illustrated by way of the following non-limiting examples.

DETAILED DESCRIPTION OF THE PREFERRED EMBODIMENTS

The following describes preferred embodiments of systems and processes used to decorate garments through printing and embroidery or the like. The goal is to use component inventory to create high-quality embellishments quickly in an MTO environment. For example, instead of a production run of a multitude of the same design, in accordance with the present invention, each garment can be decorated with a unique and custom design. The direct-to-transfer printing system of the present invention preferably uses a novel configuration of heat presses and other equipment to sequence the components so they properly marry with their corresponding garments. The direct-to-transfer printing process of the present invention include both a manual process and an automated process, the latter using an ASR system for storing and retrieving components. A control system and associated software ensure a sequenced delivery of the components to their corresponding garments.

Figure 1:
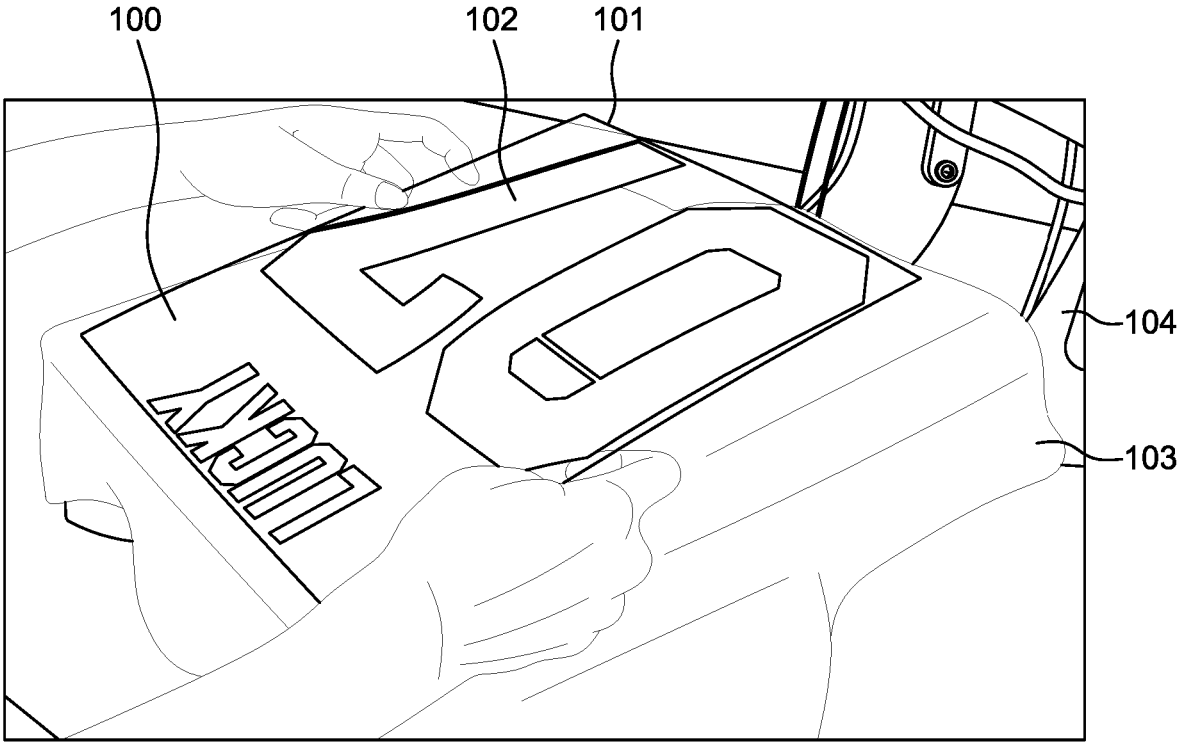
FIG. 1 depicts a conventional component applied to a garment on a heat press.
Figure 2:
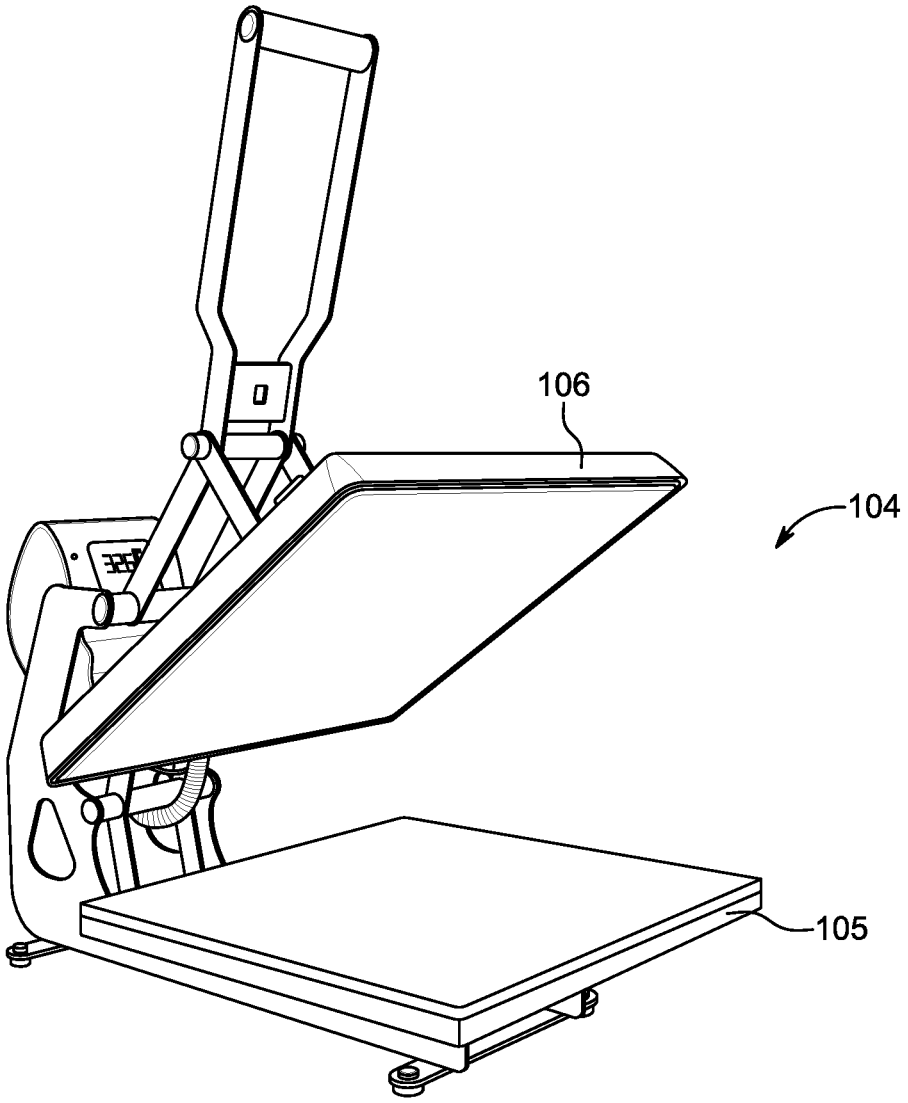
FIG. 2 depicts a conventional heat press.
Figure 3:
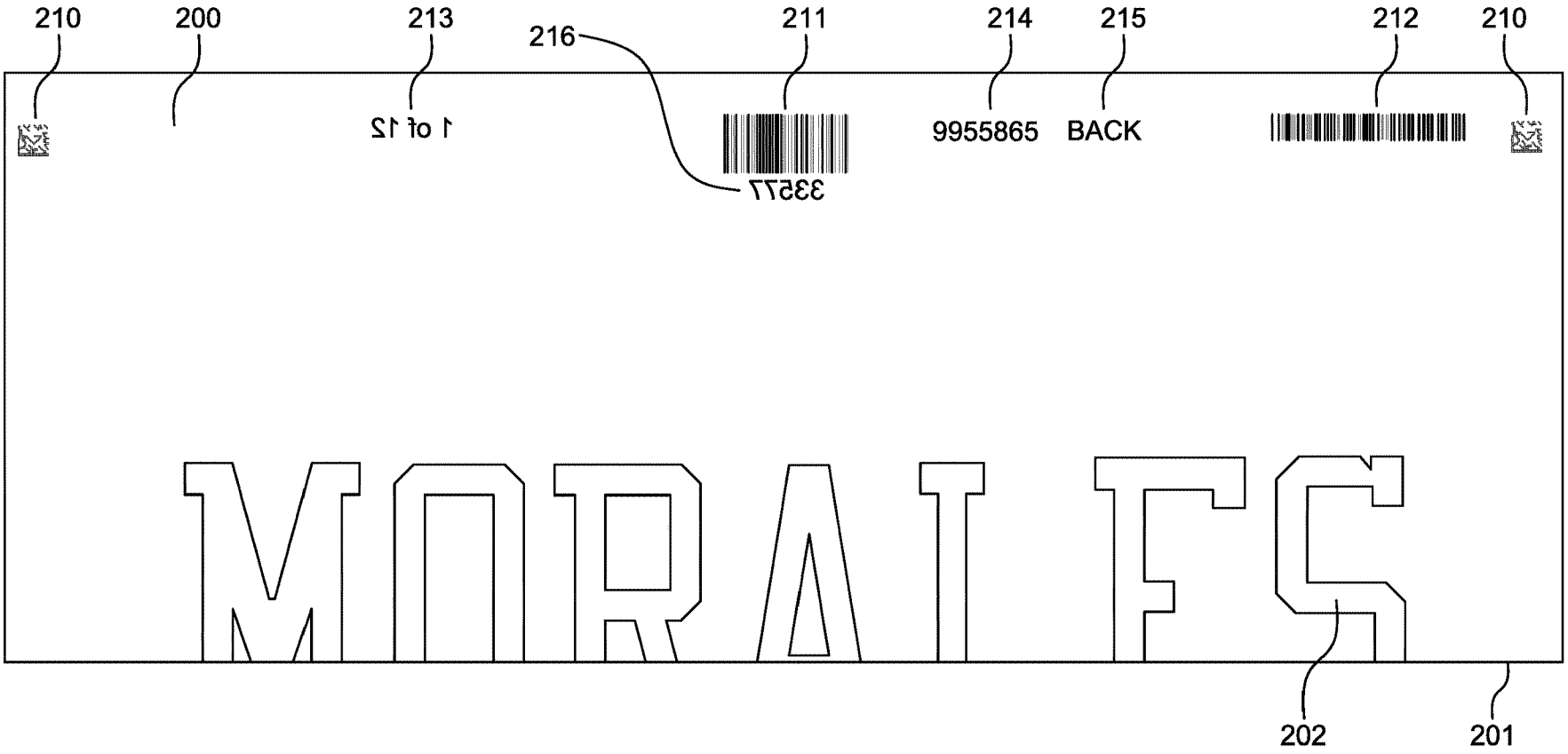
FIG. 3 depicts a component including identification and registration barcodes, in a preferred embodiment of the present invention.

A novel component 200 should preferably have the following features for the direct-to-transfer printing system and process of the present invention to work more easily and efficiently, including identification and registration symbols examples of which are shown in FIG. 3. An identification symbol 212 (a barcode as shown, or a QR code or the like) should be printed or otherwise placed on the component 200 to identify it, and one or more separate registration symbols 210 to permit the equipment to properly orient the component during processing.

A component should preferably remain consistent as to its location of application on garments. The equipment and control system should know the size of the carrier sheet 201 of each given component, which is preferably standardized, and where the identification symbols 212 and registration symbols 210 may be found thereupon. Preferably, the identification symbols 212 and registration symbols 210 should be in the same location on each component, so that they may be more easily scanned and read. The identification symbol 212 should preferably be unique so that the correct component is identified when it is called upon by the control system.

The identification symbol 212 for a component 200 is created with information to identify the component. The identification symbol may also contain a sequence number if the component is being generated by a control system that creates components using a batch of MTO items, and a location number specific to the MTO item being produced. The component may also have printed thereon that sequence number 213 and location number 214, an indication of Front or Back 215, and a batch number 216 (corresponding to batch number barcode 211). If, however, an ASR system is being used, the sequence is built dynamically by the control system interacting with the ASR system. Accordingly, the sequence number in 213 are not required to be printed on the component, but that is nonetheless preferred by the ASR system for manual exception resolution.

Figure 4:
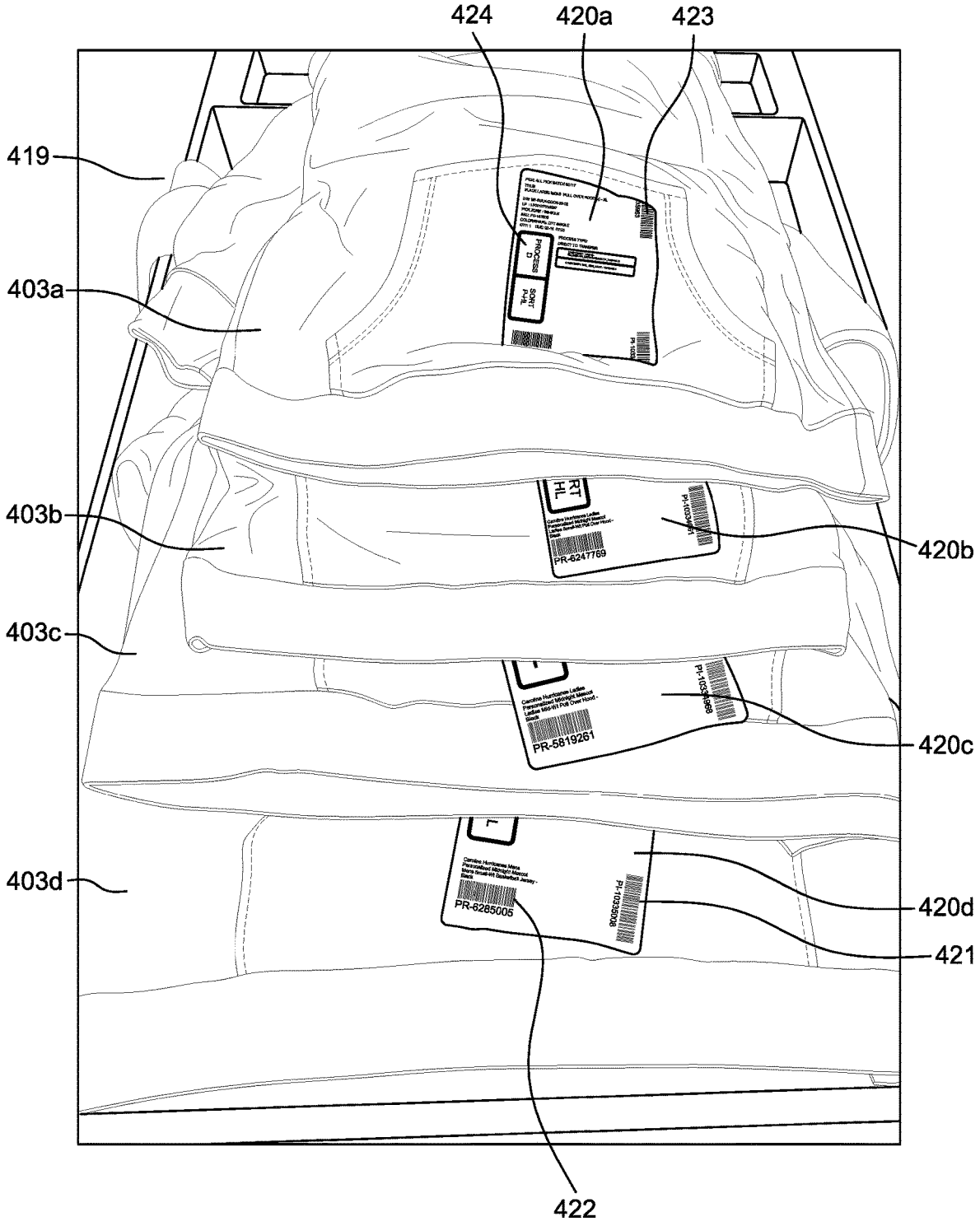
FIG. 4 depicts a stack of MTO garments in sequence, with each garment having a sticker placed thereon and the stickers including symbols (barcodes) and other information, in a preferred embodiment of the present invention.

As shown in the example of FIG. 4, batch 419 is a stack of garments 403 (here, garments 403*a*-403*d*) and provides the starting and ending numbers of a sequence. Barcode 423 (which can alternatively be a QR symbol or the like) is located on the garments stickers 420 (here garment stickers 420*a*-420*b*, see FIGS. 4 and 5), and represents the work order to make the associated MTO item. When the barcodes 423 of the garments of the batch are scanned, that batch gets assigned sequence numbers 413 which are then printed on the components 400. The component also contains a design 402 printed on a carrier sheet 401, as well as registration symbols 410, identification symbol 412, front/back indicator 415, batch number 416 (and corresponding batch barcode 411), and MTO item location number 414. When manually processing the batch of garments, the garments are sorted in the desired order and the corresponding components for that batch are arranged in the same order, in accordance with the sequence numbers printed on the garments and components respectively.

Figure 5:
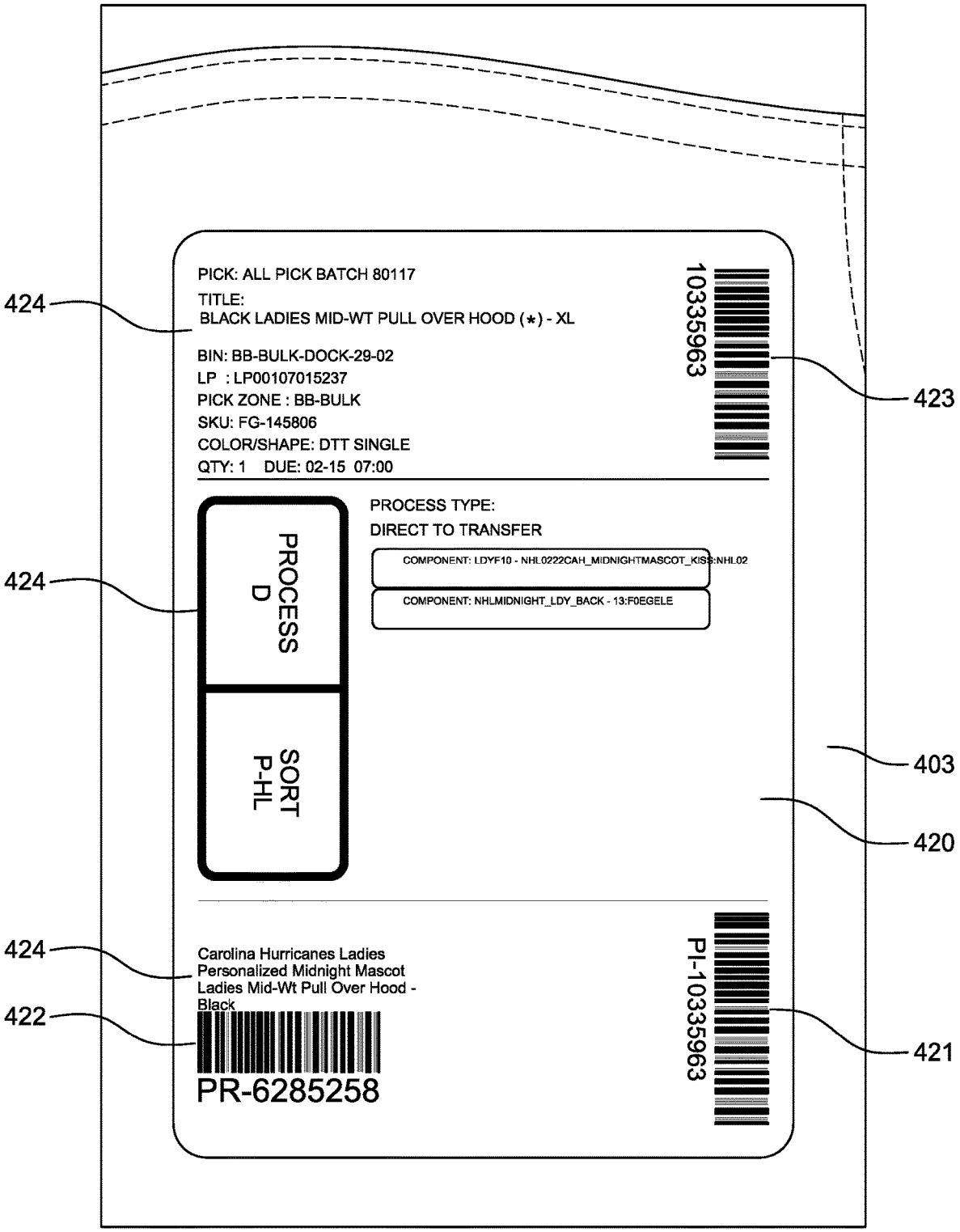
FIG. 5 depicts a close up of the symbols and other information on the stickers of FIG. 4.

The garment stickers 420 may also contain barcode 421, which may be the same as barcode 423 or, as shown in FIG. 5 contain additional information. Barcode 422 represents the finished custom item that is put into a Work Management System (WMS) inventory. It may be required for reusability of returns and for pre-making popular items in advance (like T-shirts with the name of an all-star football player). The garment stickers 420 may further contain other information 424 about the garment.

In the case of manual processing, the identification symbol 212 contains a sequence number and simply identifies the design on the component and is used as a check. For example, as the garment is scanned at the beginning of the press cycle for embellishment, the component 200 is automatically scanned shortly thereafter and checked to confirm it is the correct one for the garment. In the event that it is not the correct one, the press will stop and the printed-out sequence numbers on the garments and components will help the operator fix the issue. If, however, the ASR system is being used, the printed-out sequence numbers are not required as they are part of the identification symbol. The garment scan initiates the component retrieval process from the ASR system (discussed in more detail below) and only a missing component, jam or other error will interrupt the process.

Figure 6:
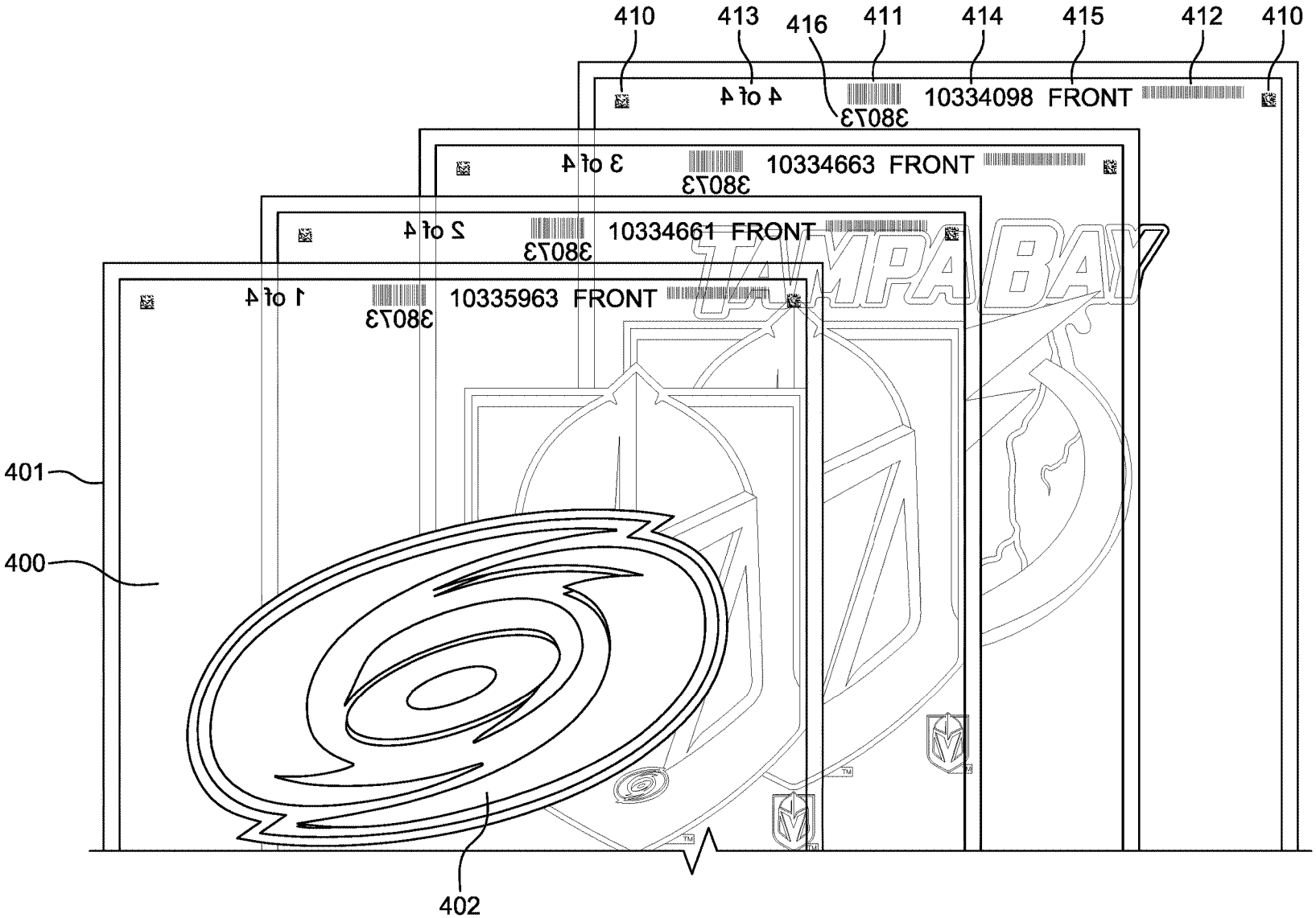
FIG. 6 depicts the front side of components in a preferred embodiment of the present invention, the components correspondingly sequenced to the garments of FIG. 5.
Figure 7:
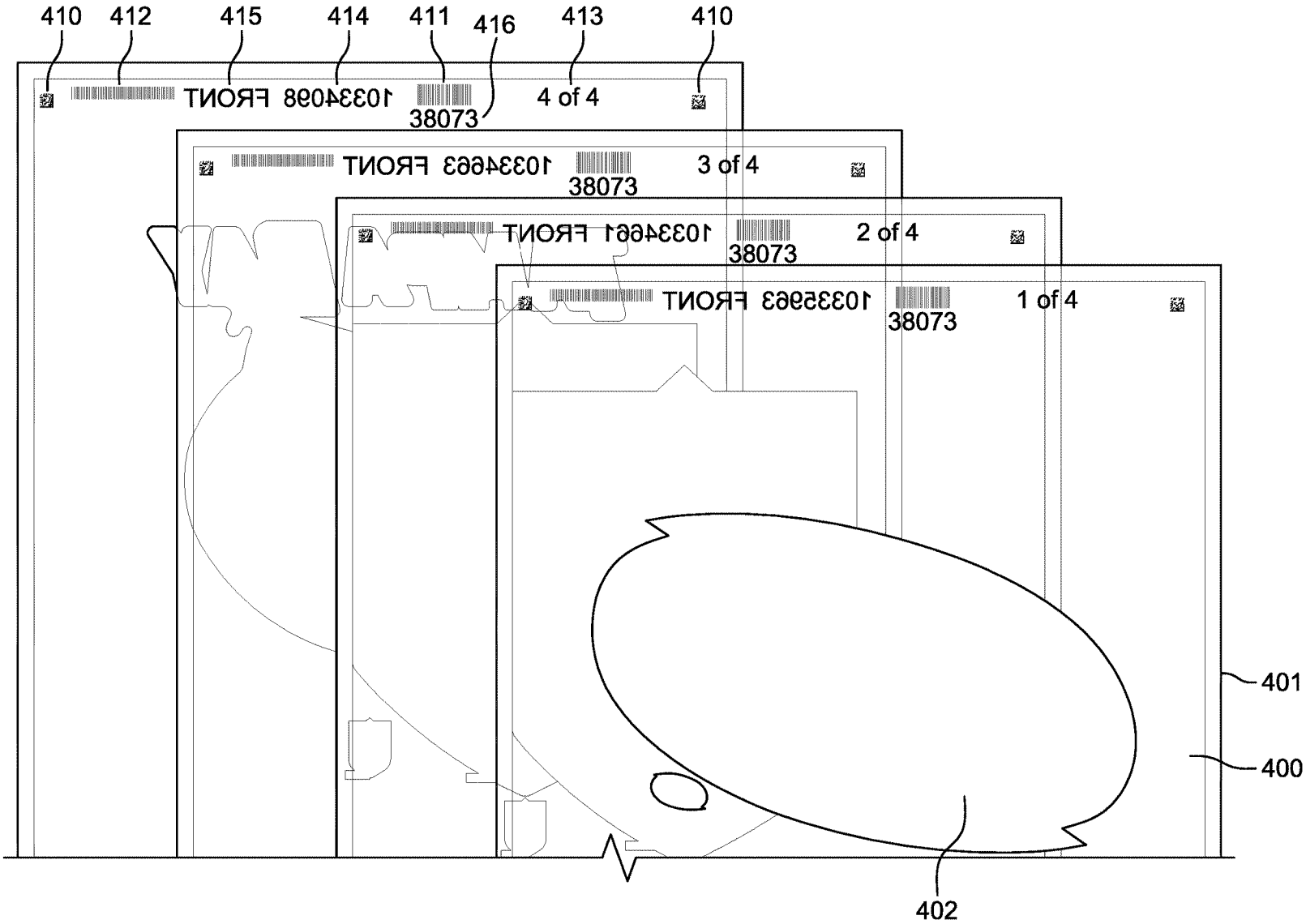
FIG. 7 depicts the back side of the components of FIG. 6.

The components should be made in a certain way so as to meet one or more of the above preferences. In particular, to fulfil an MTO request and to more easily add a unique identification symbol to each component, the component should preferably be produced digitally. With a digital production processor, no screen or die is required and every component can be unique. For example, the color portions of the design 402 (which includes black and white) are applied to the carrier sheet with a digital offset press (see FIG. 6, the front of the component, which contains the color portions of the design 402). White ink is added to the adhesive, and the mixture is used to coat the back of the design to provide opacity, so that the garment color isn't visible through the component once it is applied (see FIG. 7, a view looking through the translucent carrier sheet to see the back of the component, which depicts the white adhesive layer of the design 402). The adhesive permits the design to adhere to the garment under heat and pressure. If necessary, excess white ink and adhesive can be cut away and removed, and the component is ready to be heat pressed to a garment. (See FIG. 7, which correctly shows the batch number 416 and the sequence numbers 1 of 4, 2 of 4, etc., because the back side of the component 400 will be placed up on the garment by the operator).

When processing manually, as stated above, the components and garments are processed and married up manually. For example, the order of the garments is first defined. The requisite number of garments are then stacked in that order, scanning each garment as it is being stacked to create a sequenced list. The sequenced list is then fed to a digital press which prints the color portion of the component and adds a batch number and a sequence number (1 of 4, for example). The garments and components are then arranged to be in the same order (the top component is applied on the top garment, etc.). This is important; if the garments and components are not in the same order, the wrong components will be applied to the wrong garments. When manually processing typically a single station heat press is used, and the operator puts a component on the front, back or sleeves. To guide the operator, "Front" or "Back" is printed on the component (the operator also has a picture of the finished product on a screen in front of him or her).

In automated processing, the operator is advised how to dress the garment on the heat presses and preferably batches only fronts together, backs together, or sleeves together, so that everything in a batch is dressed the same way and the garments and components match up at station 909. The control system displays information on dressing and tracks operator productivity through the interface 901. The components and garments are thus automatically processed pairwise and sequentially (e.g., a component and corresponding garment for each transacted order). The unique MTO item information in the identification symbol allows for detecting out-of-order components and the sequence numbers also permits the operator to manually fix the sequence of components, so the components can be correctly matched up to their intended garments.

Figure 8:
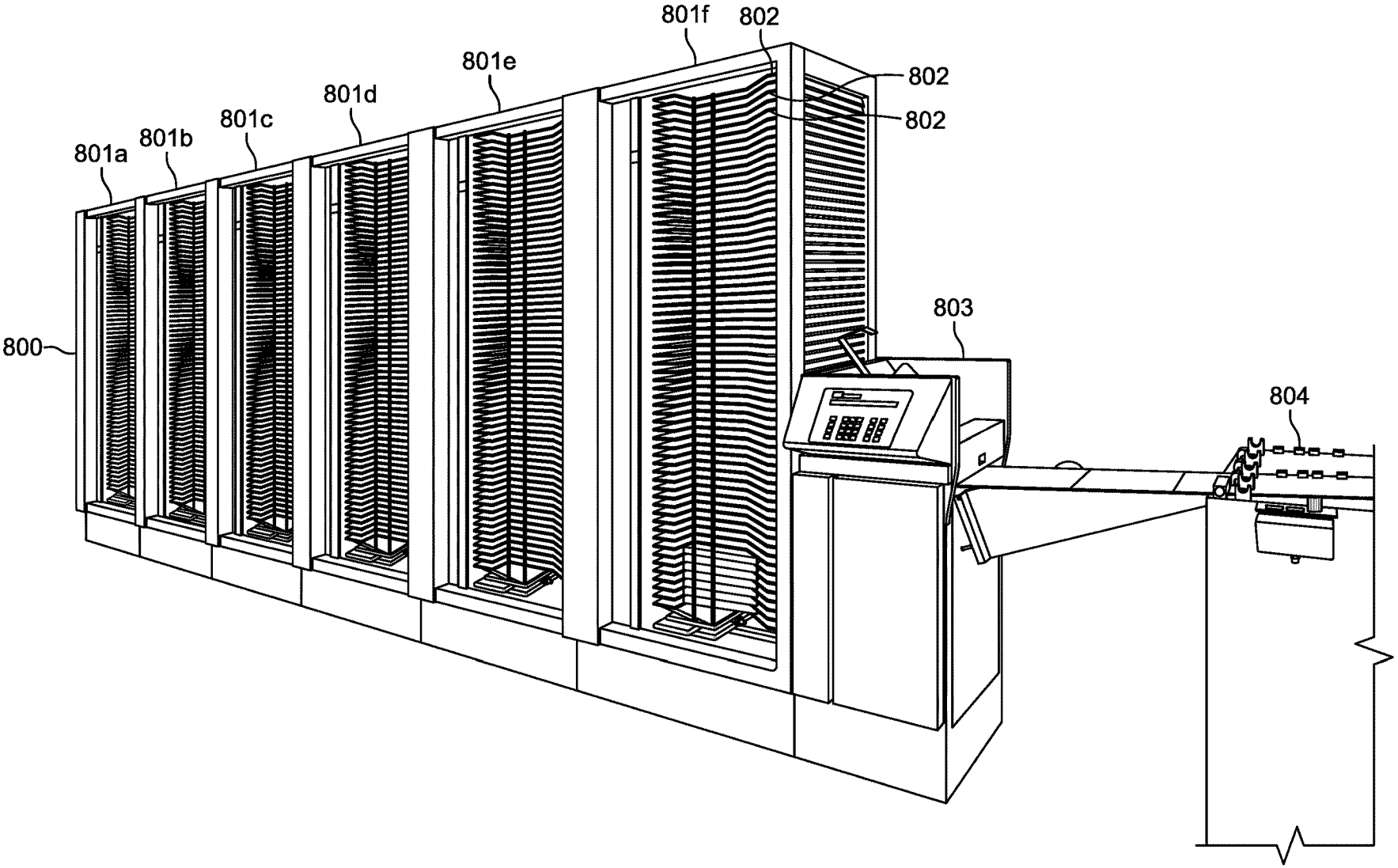
FIG. 8 depicts an example of an Automated Storage and Retrieval (ASR) system that can be used in a preferred embodiment of the present invention.

An ASR system similar to the collator 800 depicted in FIG. 8 can be used to automate the sequencing of components. One purpose of the ASR is to insure the sequence of blank garments marries with the sequence of the corresponding components when the components arrive at one or more application stations.

In the ASR 800, there are a number of vertical storage modules 801 (here, 801*a*-801*f*), each module with 50 to 100 storage locations 802 each. Each storage location 802 is sized to the specific carrier sheet size being used and preferably holds only one sheet. Though it is realistic that many of the same component designs will be stored in the system, limiting each storage location to one carrier sheet keeps the transportation mechanism simpler and reduces jams and other issues. The entire system is managed by a control system 803 that manages the contents of each location and determines the most efficient way or ways to load and unload the components, as well as provide a user interface for inventory and error handling functions.

After the components are created, preferably by the digital production processor, they should be delivered to the ASR system 800 one at a time. That is, they can be conveyed one at a time directly from the digital production processor into the ASR system, or they can be stacked in bulk into a sheet feeder that will introduce the components into the ASR system one at a time. Additionally, the components should all be orientated the same way so that the identification symbol is in the same location as each sheet is added to the ASR system.

For example, the carrier sheet of the component is delivered to, or placed on, an input registration conveyor 804. This lines up the component in the precise location for the system and minimizes paper jams. Because the starting location of the component (either conveyed from the end of the creation process or delivered via a sheet-feeder) is already fairly precise, only about an 18" input registration conveyor section should be required.

After each sheet is registered (immediately after placement on the input registration conveyor is preferable) per the registration (orientation) codes, the identification symbol (e.g., barcode) on the leading edge is scanned by a camera (not shown) mounted at the far end of the registration conveyor. The control system that manages the ASR system 800 registers the identification number scanned by the camera and determines where the item will be stored. It is preferable to register the identification number or utilize a check-digit to ensure the camera doesn't mis-scan the barcode. The system should preferably stop processing or reject the scanned component (ejecting it from the ASR system 800) in the event of an error, mis-scan or lack of available locations.

The path to the appointed location 802 in the ASR system 800 is then opened up and the component is then delivered to that location. The carrier sheets are preferably transported by a system of mechanically adjustable vertical and horizontal conveyors. The vertical storage modules 802 preferably move up and down to precisely line up with the input registration conveyor. The vertical storage modules 801 may also rotate to increase the number of locations 802 on each module.

Each location 802 of the ASR system 800 is understood by the control system, and a location should be understood to be empty (available) before a component can be stored therein. When the component is stored the unique component identification number is paired with the location's identification number, so when the control system calls for the unique component identification number, it is pulled from the correct location. The ASR system 800 is preferably sized to store as many components as possible without slowing down the delivery to or from a given location.

For example, in a large, complex system, it may take 10 seconds to align the correct vertical storage module with the input registration conveyor path, 2 seconds to deliver the scanned and registered component to the location and another 12 seconds to align the path and retrieve a component (as described below). In this scenario, there may be 24 seconds in between each component storage process, where the ideal time should be closer to 3 seconds. These design and timing issues may be accounted for in three ways.

First different conveyance systems are created for storage and retrieval of components that intersect as little as possible. A component can be retrieved from one module at the same time another component is stored in another module. Second, the number of storage locations in one ASR system (or in a network of two or more ASR systems) to reach the required storage capacity is limited. A process for defining which system to route a component should preferably be established, as well as a process for keeping components delivered from different ASR systems sequenced correctly. Third, the number of conveyor paths are increased within an ASR system. After a component is scanned and registered, the ASR system can deliver the carrier sheet to one of three different horizontal conveyors to get the carrier sheet to its storage location. By rotating through these conveyors the original delivery time will be sped up accordingly.

Retrieval of the component from the ASR system 800 works almost the same way as storage. A symbol (e.g., barcode) on a garment is scanned and this initiates the retrieval process. The path from the storage location to an output conveyor (which could be the same device as the component delivery conveyor 902 discussed in more detail below) is opened up in a manner similar to when the component was stored. The retrieved components are transported to the output conveyor that delivers them—in the same sequence the scans to initiate their retrieval occurs in—to the application stations of the direct-to-transfer printing system, preferably via a registration conveyor 903 (see FIG. 9).

Figure 9:
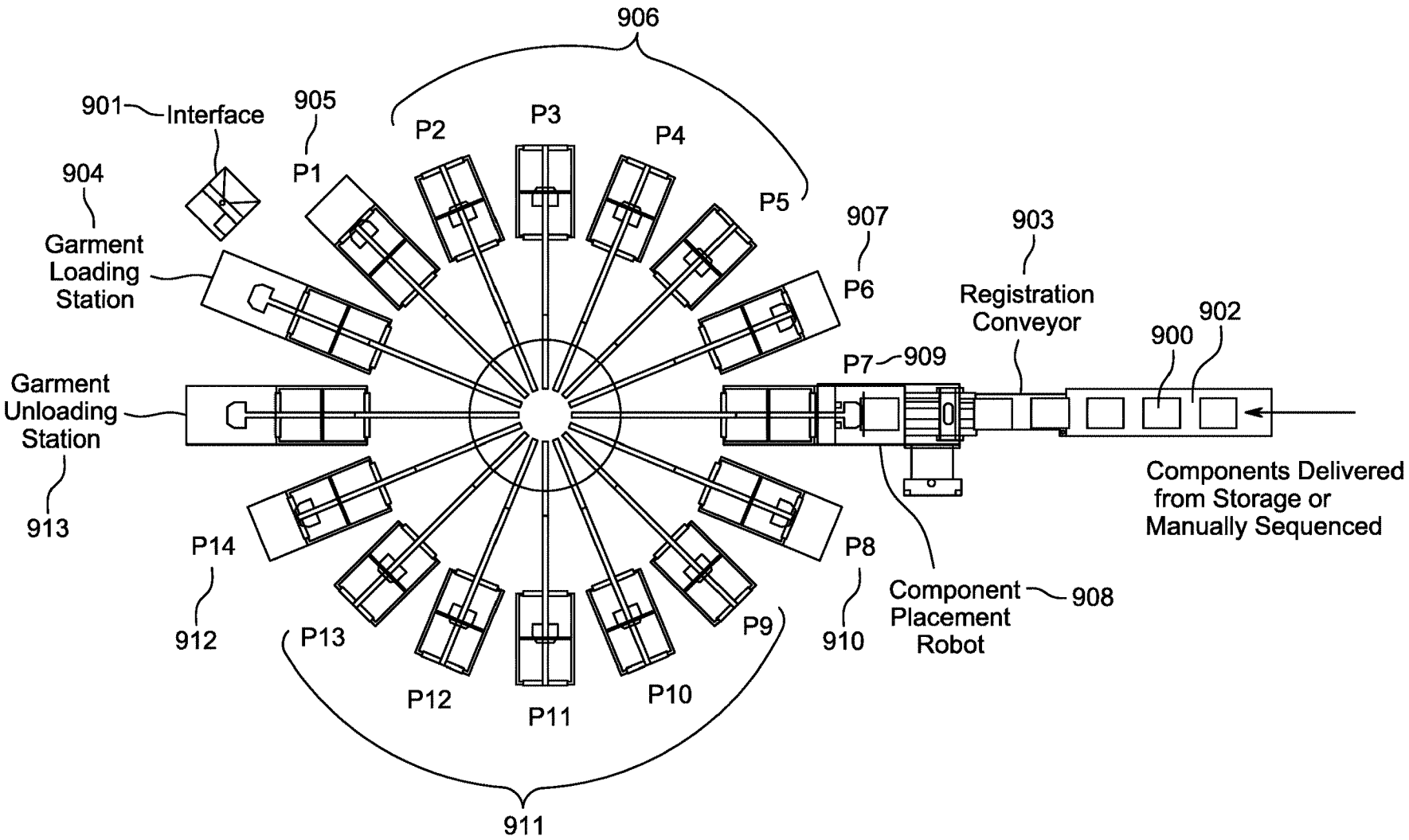
FIG. 9 depicts a configuration of heat presses and other equipment that are configured to perform a direct-to-transfer printing process in accordance with a preferred embodiment of the present invention.

As shown in the example shown in FIG. 9, the application stations of the direct-to-transfer printing system preferably include (1) a garment loading station 904 at which garments are loaded onto heat press pallets (e.g., the garments are dressed on the lower heat press platens); (2) a pre-press engage station 905 at which the pre-press process begins; (3) one or more pre-press stations 906 at which the garments are pre-pressed by the heat presses; (4) a pre-press disengage station 907 at which the pre-press process ends; (5) a component placement station 909 at which sequenced components are correspondingly placed on top of their intended garments via a component placement robot 908; (6) a press engage station 910 at which the heat press process begins; (7) one or more press stations 911 at which heat and pressure are applied to the components by the heat presses, thereby fusing the components (and their designs and embellishments) to the garments; (8) a press disengage station 912 at which the heat press process ends; and (9) a garment unloading station 913 at which the garments are unloaded from the heat press pallets. The configuration of the application station equipment is preferably circular (as shown in the example of FIG. 9) or ovular, and preferably of sufficient diameter to include the many heat presses (1)-(9) as they index (e.g., rotate) from station to station.

At the garment loading station 904, the heat pallet (e.g., the upper platen of the heat press) is disengaged and out of the way of the operator, providing easy access to dress a garment onto the bottom platen of the heat press, as well as scan a barcode affixed in a particular location on the garment (for example, on the sticker 420) that identifies the corresponding component.

When the identification symbol on the garment is scanned, the control system insures the corresponding component is next component in the sequence. If the sequence is manually processed via sequence numbers printed on the components, the scan triggers the component to be loaded onto the component delivery conveyor and the sequence is validated against the sequence of the garment. If the component and garment sequences are misaligned, the press does not index until the proper alignment of the component and garment sequences is re-established. A display panel for the operator can help clear the issue.

If the ASR 800 is used to sequence the components, the garment scan will trigger the ASR to retrieve the appropriate component and deliver it (via robotic arm, conveyor or other device) to the application station equipment. In a preferred embodiment, the system has a minimum of 30 seconds to retrieve a component and deliver it to the application station equipment.

The application station equipment automatically indexes at a desired rate (for example, the application stations rotate every 5 seconds). At the second application station, the pre-press engage station 905, the heat press is engaged into a pressing position to "pre-press" the garment. This flattens the garment and removes any moisture. The heat press stays engaged for a set number of seconds as the press indexes at the desired rate, thus the system should have enough pre-press stations 906 to index through to reach the total pre-press time. At the pre-press disengage station 907, the heat press preferably disengages automatically after the pre-press time has passed.

Next there is a component placement station 909, at which components are placed on top of their corresponding garments dressed on the heat presses. As a disengaged heat press pallet with a garment with a certain barcode indexes into the component placement station 909, the robotic arm of a component placement robot 908 moves the component corresponding to that garment off the component queue and places it on top of the garment.

At the next station, the press engage station 910, the press is engaged again to apply heat and pressure to the component. The press stays engaged for a desired amount of time through as many press stations 911 as necessary to fuse the component to the garment, and disengages at the press disengage station 912.

At the garment unloading station 913 (the final station right before the press indexes back into the garment loading station 904), the garment with the heat pressed component is removed from the press by an unloading operator. The component's carrier sheet is removed and discarded.

The total number of stations on the press are set to provide maximum throughput. The speed of the direct-to-transfer printing system should preferably be directly related to the speed of the loading and unloading operators, and not related to any limitations of the application station equipment.

For example: Assume that the fastest an operator can load a garment onto a pallet is 5 seconds. Further assume the slowest pressing garment requires 20 seconds for pre-pressing the garment and 25 seconds to press the component onto the garment. FIG. 9 and the following describes the mechanical operations and the quantity and function of the press stations of the direct-to-transfer printing system and process.

1. Computer Interface 901—The computer interface 901 at which the loading operator scans the barcode on each garment before loading. This interface also allows the operator to adjust various machine parameters and alert the operator of any issues.
2. Component Delivery Conveyor 902—The component delivery conveyer 902 delivers the components to the application station equipment in the desired sequence. Either the scan at the computer interface initiates the retrieval of the component from the ASR system 800 or the garment scan coincides with a check scan at this conveyor; if the scans do not align the press should not index until the sequence is fixed.

3. Registration Conveyor 903—A registration conveyer preferably follows the component delivery conveyor to ensure the component is perfectly lined up for the component placement robot 908.
4. Garment Loading Station 904—The lower pallet is fully disengaged from the heated pallet and easily accessible to the loading operator.
5. P1—Pre-press Engage Station 905—The heat press has 5 seconds to retract the lower pallet and engage the upper pallet with the lower pallet to begin the pre-press process.
6. P2 through P5—Pre-Press Stations 906—The heat press stays engaged to pre-press the garment. Depending on the desired pre-press time, it may disengage any time before pre-press disengage station P6.
7. P6—Pre-Press Disengage Station 907—Provides time for press to be fully open to receive the component.
8. Component Placement Robot 908—The component placement robot is preferably lined up with the component placement station 909. At one end of the component placement robot 908, the information on the component is scanned. This allows for a final scan to ensure the component is correct as well as to capture the exact picking point of the robotic arm. The robotic arm has suction cups and grippers that will pick up the front edge of the component and move it across the gap to the precise position on the pallet. There is preferably an additional camera or set of cameras at the far end of the robot to ensure precise placement of the component (and to ensure it did not slip out of place). The camera or cameras use the registration barcodes 410 to adjust the orientation of the component.
9. P7—Component Placement Station 909—The lower pallet is fully disengaged and the component is placed on the pallet in the correct location.
10. P8—Press Engage Station 910—The heat press retracts the lower pallet and engages the upper pallet with the lower pallet to begin the pressing process.
11. P9 through P13—Press Stations 911—The heat press stays engaged to fuse the component to the garment. Depending on the desired press time, it may disengage any time before press disengage station P14.
12. P14—Press Disengage Station 912—Provides time for the heat press to be fully open to unload the garment
13. Garment Unloading Station 913—The lower pallet is fully disengaged from the heated pallet and easily accessible to the unloading operator, who removes the garment with the fused component.

In this example, the system has 16 stations and there is a minimum of 30 seconds between when the garment barcode is scanned and when the component should be delivered to the heat press. Once the equipment has been operated continuously for about 80 seconds, a pressed garment will preferably be unloaded every 5 seconds (or 720 heat press impressions per hour)—and importantly, each MTO garment may have a different design. This rate far exceeds anything that presently exists for making MTO garments, potentially each with differing designs.

While preferred embodiments have been described, it is evident that many additional modifications, variations or alternatives are apparent to the skilled artisan. The present application intends to embrace all of such modifications, variations or alternatives which fall within the scope of the invention.

What is claimed is:

1. A direct-to-transfer printing system comprising:

a plurality of heat presses;

a corresponding plurality of heat press stations through which the heat presses are indexed, and at which garments are (1) dressed upon the heat presses; (2) the garments are pre-pressed; (3) thereafter components are sequentially placed on top of and fused with their corresponding garments by applying heat and pressure; and (4) the finished garments are unloaded from the heat presses;

a component placement robot to place the components on top of their corresponding garments;

a plurality of conveyors to deliver the components to the component placement robot, wherein one conveyor is a component delivery conveyor to deliver the components fed thereto automatically or manually; and an automated storage and retrieval system, wherein the components are automatically fed to the component delivery conveyor by the automated storage and retrieval system.

2. A system according to claim 1, wherein the heat press stations comprise one or more of the following stations: a garment loading station at which garments are loaded onto pallets of the heat presses; a pre-press engage station at which the pre-press process begins; one or more pre-press stations at which the garments are pre-pressed by the heat presses; a pre-press disengage station at which the pre-press process ends; a component placement station at which components are sequentially and correspondingly placed on top of their intended garments; a press engage station at which the heat press process begins; one or more press stations at which heat and pressure are applied to the components by the heat presses, thereby fusing the components to the garments; a press disengage station at which the heat press process ends; and a garment unloading station at which the garments are unloaded from the heat press pallets of the heat presses.

3. A system according to claim 1, wherein another conveyor is a registration conveyor which receives components from the component delivery conveyor and orients them for delivery to the component placement robot.

4. A direct-to-transfer printing system comprising:

a plurality of heat presses;

a corresponding plurality of heat press stations through which the heat presses are indexed, and at which garments are (1) dressed upon the heat presses; (2) the garments are pre-pressed; (3) thereafter components are sequentially placed on top of and fused with their corresponding garments by applying heat and pressure; and (4) the finished garments are unloaded from the heat presses; and a computer interface to scan in the garments.

5. A system according to claim 4, wherein when a garment is scanned in, the corresponding component is retrieved from an automated storage and retrieval system.

6. A direct-to-transfer printing process comprising the steps of:

sequentially delivering garments to a plurality of heat presses configured in corresponding plurality of heat press stations, wherein the heat presses index from one station to another;

loading the garments onto the heat presses;

pre-pressing the garments with the heat presses;

delivering a sequence of components to the heat presses, wherein the components are automatically delivered from an automated storage and retrieval system;

placing the components on top of their corresponding garments;

fusing the components to their corresponding garments; and unloading the finished garments from the heat presses.

7. A process according to claim 6, wherein the components are manually delivered.

8. A process according to claim 6, wherein the indexing is done by rotating the heat presses from station to station.

9. A manufacture for use in a direct-to-transfer printing system comprising:

a carrier sheet;

a component on the carrier sheet, including: a design or embellishment;

one or more identification symbols; and one or more registration symbols.

10. A manufacture for use in a direct-to-transfer printing system comprising:

a carrier sheet;

a component on the carrier sheet, including: a design or embellishment; and one or more identification symbols, wherein the component further includes a sequence number for manual application to a batch of corresponding garments.

11. An automated storage and retrieval (ASR) system for use with a direct-to-transfer printing system, comprising:

one or more vertical storage modules, each vertical storage module comprising a plurality of storage locations for storing components; and a control system for storing the storage and retrieval of the components to and from their respective storage locations.

12. An ASR system according to claim 11, further comprising a registration conveyor for orienting the components and inputting the components into the ASR system for storage into the storage locations.

13. An ASR system according to claim 11, further comprising an output conveyor for delivering the components retrieved from the storage locations to the direct-to-transfer printing system.

14. An ASR system according to claim 13, wherein a component is retrieved from the ASR system for delivery to the direct-to-transfer printing system when a garment is scanned into the direct-to-transfer printing system.

15. An ASR system according to claim 12, further comprising mechanically adjustable horizontal and/or vertical conveyors for delivering the components from the registration conveyor to their respective storage locations.

* * * * *